US008857205B2

(12) United States Patent
Sherman

(10) Patent No.: US 8,857,205 B2
(45) Date of Patent: Oct. 14, 2014

(54) RAPID FLUID FREEZING DEVICE

(76) Inventor: Jason S. Sherman, Hallandale Beach, FL (US)

( * ) Notice: Subject to any disclaimer, the term of this patent is extended or adjusted under 35 U.S.C. 154(b) by 1244 days.

(21) Appl. No.: 12/243,159

(22) Filed: Oct. 1, 2008

(65) Prior Publication Data

US 2010/0077773 A1 Apr. 1, 2010

(51) Int. Cl.

| | |
|---|---|
| ***F25D 3/00*** | (2006.01) |
| ***F25D 3/10*** | (2006.01) |
| ***F25C 1/00*** | (2006.01) |

(52) U.S. Cl.

CPC .... *F25D 3/10* (2013.01); *F25C 1/00* (2013.01)

USPC ..... 62/386; 62/66; 62/68

(58) Field of Classification Search

CPC ..... A23G 9/045; A23G 9/083; B67D 1/0862; F25C 1/04

USPC ..... 62/70, 66, 388, 384, 386, 457.3, 457.9, 62/457.4, 457.5, 390, 342; 426/515

See application file for complete search history.

(56) References Cited

U.S. PATENT DOCUMENTS

| | | | | |
|---|---|---|---|---|
| 3,128,995 | A * | 4/1964 | Shaeffer | 366/145 |
| 4,557,117 | A * | 12/1985 | Furia et al. | 62/340 |
| 4,942,742 | A * | 7/1990 | Burruel | 62/347 |
| 6,513,337 | B1 * | 2/2003 | Astvatsatrian et al. | 62/66 |
| 6,604,654 | B2 * | 8/2003 | Staten et al. | 222/1 |
| 6,636,151 | B2 * | 10/2003 | Busick | 340/521 |
| 2004/0003621 | A1 * | 1/2004 | Zevlakis | 62/352 |
| 2005/0268624 | A1 * | 12/2005 | Voglewede et al. | 62/126 |
| 2007/0130965 | A1 * | 6/2007 | Boarman et al. | 62/135 |
| 2008/0041070 | A1 | 2/2008 | Johnson et al. | |
| 2009/0120107 | A1 * | 5/2009 | Oztas et al. | 62/63 |

FOREIGN PATENT DOCUMENTS

| | | | | |
|---|---|---|---|---|
| WO | WO2006/092535 | * | 9/2006 | F25C 1/10 |

* cited by examiner

*Primary Examiner* — Cassey D Bauer

(74) *Attorney, Agent, or Firm* — Christopher & Weisberg, P.A.

(57) ABSTRACT

The present invention provides a method and apparatus for freezing an alcoholic beverage, including placing an alcoholic beverage into a beverage receptacle; dispensing a predetermined amount of the alcoholic beverage into a plurality of freezing cavities; transferring liquid nitrogen from a coolant reservoir to a plurality of coolant chambers; exposing the plurality of freezing cavities to the liquid nitrogen to freeze the alcoholic beverage; and removing the frozen alcoholic beverage from the freezing chamber.

9 Claims, 7 Drawing Sheets

RAPID FLUID FREEZING DEVICE

CROSS-REFERENCE TO RELATED APPLICATIONS n/a

STATEMENT REGARDING FEDERALLY SPONSORED RESEARCH OR DEVELOPMENT n/a

FIELD OF THE INVENTION

The present invention relates to a method and device for the rapid freezing of fluid and in particular, to a method and device for the creation of frozen alcoholic beverage cubes.

BACKGROUND OF THE INVENTION

Traditional methods of freezing liquid compounds often involve storing the liquid compound in a freezer and waiting overnight for the liquid compound to freeze. For example, water is typically frozen into ice cubes by filling an ice tray with water and placing the tray in the freezer. A home freezer often provides sufficient cooling capacity to freeze liquid compounds such as water, juice, soda, and ice-cream mix. However, traditional home freezers do not reach the low temperatures that are necessary to freeze beverages made from drinking alcohols, liquors and distilled spirits that are ethanol-based.

Ethanol is the active ingredient in many popular alcoholic drinks. Ethanol has a freezing point of −114 degrees Celsius (−114° C., −173.2° F.), which is significantly lower than the 0° C. freezing point of water. Drinking alcohols, liquors and distilled spirits are generally measured by proof content, which is directly related to the percentage of alcohol present (e.g., 80 proof has an alcohol content of 40%; 100 proof: 50%, etc.). Alcoholic beverages that are in the proof range of 10-25 will typically freeze in a standard freezer since most home freezers are only capable of achieving a temperature of about −18° C. or higher. However, the higher alcoholic content of higher proof beverages lowers the temperature at which the liquids freeze into solids. Consequently, alcoholic beverages having higher proofs cannot be frozen in typical home freezers.

Additional freezing techniques for freezing select liquids and mixtures into solids are used for chilling alcohol mixtures, but such methods are unable to freeze high-proof beverages into a solid. One method uses the cooling energy provided by melting ice and is similar to processes used to make ice cream. In particular, ice is packed with rock salt to lower the freezing point, thus making the ice even colder. The ice is packed between a drum and a canister containing the mix, and periodically replenished as it melts. The canister is then rotated or circulated within the drum until the mixture is sufficiently frozen. However, this technique will not work to freeze drinking alcohols, liquors or distilled spirits into a solid because the temperatures reached using this method are not low enough. Moreover, this technique requires constant disposal of water and constant attention and maintenance, making it impractical and undesirable in a personal or social setting.

Other methods freeze mixtures of alcohol-based beverages into slush for drinking purposes. The mixtures made in these appliances generally have only a small amount of alcohol content compared to beverage mix content. This results in a higher freezing point allowing the combined alcohol and beverage mix to congeal and remain in a slush state. However, these appliances are not capable of freezing high proof alcohols past the slush state into a solid since the industrial refrigeration units on these units are typically not capable of achieving the required low temperatures for freezing alcohol into a solid.

While specialized refrigeration equipment or batch freezers may be available for industrial applications specifically requiring such drastic sub-freezing temperatures, such equipment is often bulky, expensive, and may include hazardous refrigerant materials or compounds. These drawbacks make use of such equipment on a personal or more social scale difficult if not impossible.

In view of the above, it is desirable to provide a device having an improved cooling mechanism to freeze liquid alcohol into a frozen alcohol mass in an accelerated manner under safe conditions.

SUMMARY OF THE INVENTION

The present invention provides a device having an improved cooling mechanism to freeze liquid alcohol into frozen alcohol cubes in an accelerated manner under safe conditions. In particular, a device for rapidly freezing a beverage is provided, including a coolant reservoir; a coolant chamber in fluid communication with the coolant reservoir; a first beverage receptacle; and a freezing cavity in fluid communication with the first beverage receptacle, where at least a portion of the freezing cavity is positionable within the coolant chamber. The device may further include a first fluid handling component in fluid communication with the coolant reservoir for selectively dispensing a coolant from the reservoir to the coolant chamber; a second fluid handling component in fluid communication with the coolant reservoir for selectively dispensing a fluid from the beverage receptacle to the freezing cavity; and a user interface controllably coupled to at least one of the first and second fluid handling components for selective operation thereof. The user interface may include a liquid crystal display, and one of a temperature sensor, pressure sensor, and flow sensor may be in electrical communication with the user interface. The device may include a dispensing mechanism coupled to the freezing cavity to dispense the contents thereof, and the freezing cavity may define a concave depression and a sloping surface.

The present invention further includes a method of freezing a beverage, including dispensing an alcoholic beverage into a freezing chamber; exposing the freezing chamber to a coolant to freeze the alcoholic beverage; and removing the frozen alcoholic beverage from the freezing chamber. Exposing the freezing chamber to the coolant may include submerging at least a portion of the freezing chamber into the coolant, and may be performed for a predetermined period of time between approximately 30 seconds and approximately 120 seconds. A predetermined amount of the alcoholic beverage may be dispensed into the freezing chamber, and the coolant may include liquid nitrogen. Further, exposing the freezing cavity to the coolant may reduce the temperature of the freezing cavity to between approximately −40° F. and approximately −160° F.

The method of the present invention further includes a method of freezing an alcoholic beverage, including placing an alcoholic beverage into a beverage receptacle; dispensing a predetermined amount of the alcoholic beverage into a plurality of freezing cavities; transferring liquid nitrogen from a coolant reservoir to a plurality of coolant chambers; exposing the plurality of freezing cavities to the liquid nitrogen to freeze the alcoholic beverage; and removing the frozen alcoholic beverage from the freezing chamber.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

New trends are constantly being developed in today's retail bar environment to increase return business. Products that accompany liquor, like "wine coolers," "Jell-O-shots," "pre-made mixed shots," and "pre-made drinks" all have developed into must have items and top-sellers in retail bar and restaurant environments. The present invention provides a rapid fluid freezing device having an improved cooling mechanism to freeze liquid alcohol into a frozen alcohol mass, such as cubes, in an accelerated manner under safe conditions. The device can be used to create a variety of new beverages containing frozen alcohol cubes derived from alcohols such as vodkas, rums, cognacs, scotches, or other liquors and distilled spirits. In addition, frozen alcohol cubes allow a consumer to cool a drink without the dilution caused by melting of typical (water) ice cubes.

Figure 1:
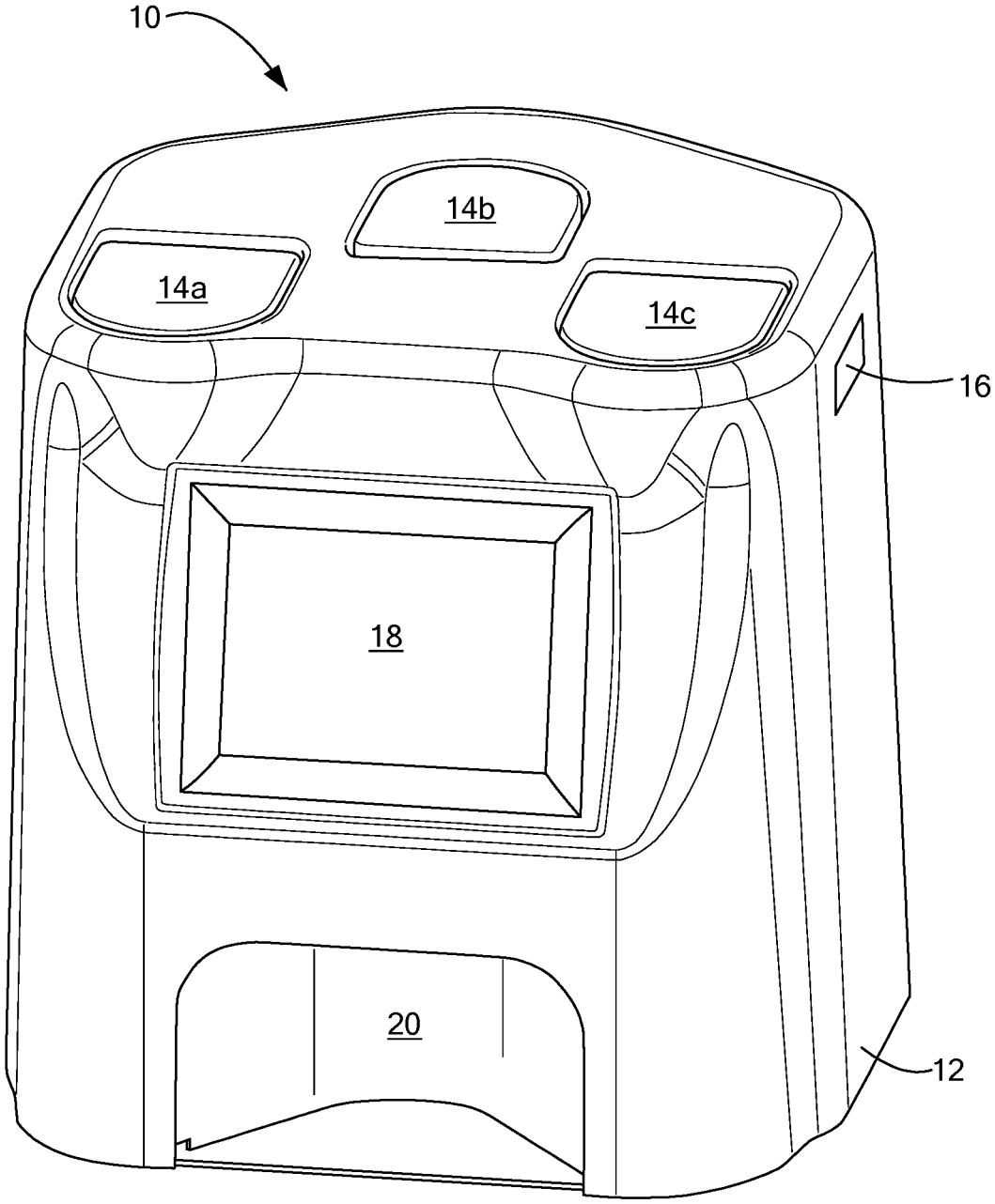
FIG. 1 is a front perspective view of an embodiment of a rapid fluid freezing device constructed in accordance with the principles of the present invention.
Figure 2:
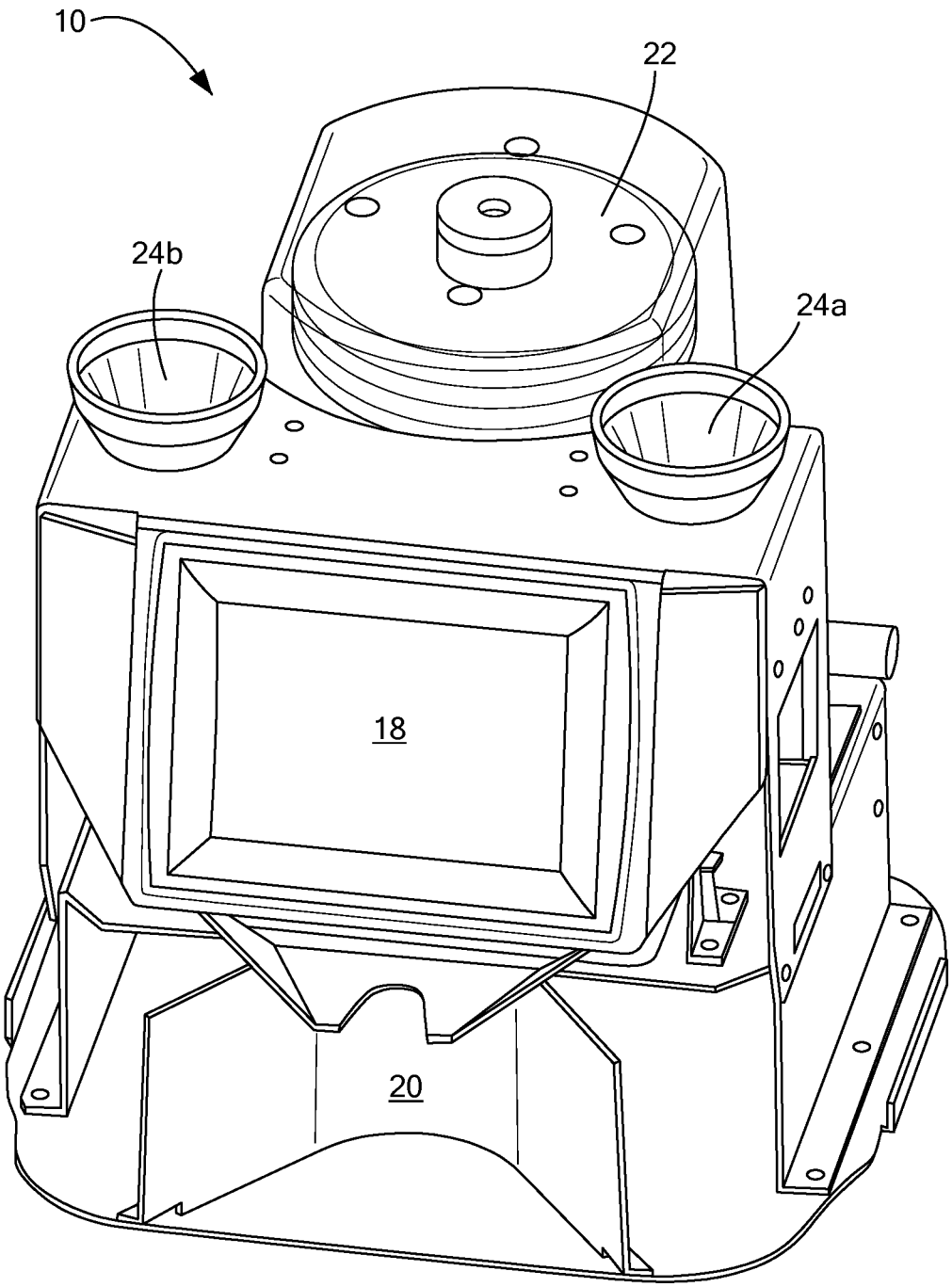
FIG. 2 is a front view of the rapid fluid freezing device of FIG. 1 with the housing removed.

Referring now to the drawing figures in which like reference designators refer to like elements, there is shown in FIG. 1 a rapid fluid freezing device constructed in accordance with the principles of the present invention, generally designated as 10. As shown in FIG. 1, the rapid fluid freezing device 10 generally includes an outer housing or shell 12 having one or more openings 14*a*, 14*b*, 14*c* on an upper surface thereof, one or more handle indentations or features 16 to ease transport and handling of the device 10, a user interface 18 for the operation and control of the device 10, and a dispensing area or region 20 where the output of the rapid fluid freezing device 10 can be collected. The openings on the upper surface of the housing 12 may provide coverable access to one or more reservoirs or receptacles for coolant or selected beverage components, such as liquor, distilled spirits or alcohols, as discussed in more detail below. The user interface 18 may include a graphic component such as a liquid crystal display ("LCD") for the selection of various operations provided by the device 10, as also discussed in more detail below.

The housing 12 encases the inner working components of the device 10 for both aesthetic, consumer marketing and safety purposes. In addition, the housing may include insulation to aid in maintaining a particular temperature within the device 10 and preventing unwanted heat exchange with the surrounding environment. The housing 12 may be constructed from a variety of materials; including plastics, metals, or foams for ease of manufacturing, cleaning, or the like, and may further be removable from an interior shell or frame to allow access to the inner workings of the device 10. The housing 12 may be molded or shaped into the form of a particular bottle of the alcohol, liquor, or distilled spirit it is dispensing.

Figure 3:
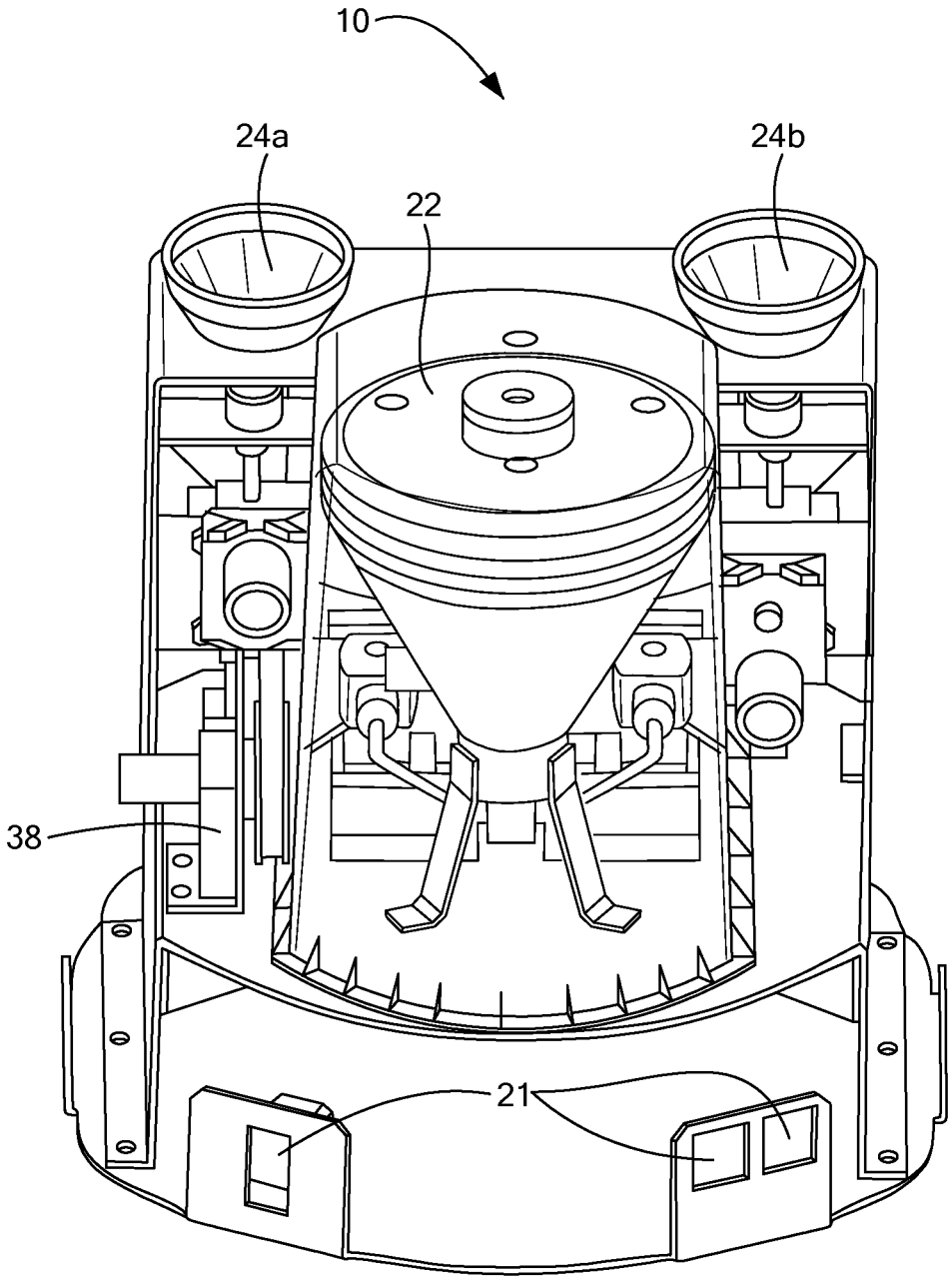
FIG. 3 is a rear view of the rapid fluid freezing device of FIG. 1 with the outer housing removed.

As shown in FIG. 3, the device 10 may include a plurality of electrical connectors 21 for sending and receiving power and electronic information. For example, the device 10 may include a networking port (such as an RJ45 wire connector or the like) for connection to a server or the Internet. The device 10 may also contain a transformer or similar power components to operate either via a battery or through standard electrical outlets. The device 10 may further include one or more USB ports or other connectivity options selectable or desirable for a particular application.

Now referring to FIGS. 2-7, various components housed within the rapid fluid freezing device 10 of the present inventions are shown. In particular, the device 10 generally includes a coolant reservoir 22 and one or more beverage receptacles 24*a*, 24*b* (collectively, 24). Both the coolant reservoir 22 and the beverage receptacles 24 may be accessible through the openings in the upper portion of the device housing 12.

The coolant reservoir 22 may define an interior volume for receiving and containing a particular coolant having the cooling capacity to rapidly freeze an alcoholic fluid. For example, the coolant may be cryogenic in nature, and include liquid nitrogen, nitrous oxide, or other suitable refrigerants. The coolant reservoir 22 may have sufficient volume to store an amount of coolant desired for a predetermined number of operational cycles or duration of use, and may also be in fluid communication with a replenishable coolant source or larger reservoir controllably delivering coolant to the reservoir 22. The coolant reservoir 22 may include a first opening on an upper portion thereof for receiving coolant, as well as one or more dispensing openings for conveying or otherwise releasing coolant to a designate portion of the device 10 where cooling is desired. For example, the coolant reservoir 22 may be in fluid communication with one or more fluid handling components 26, such as valves, pumps or regulators for the controlled and selective delivery of coolant at a desired volume, pressure, and/or flow rate. The fluid communication may be achieved through the interconnection of piping or similar conduits able to withstand the particular temperature range of the selected coolant, such as those constructed from copper, stainless steel, inert or non-inert plastic compounds, and the like. The tubing or conduits may also be insulated to reduce infiltration of thermal energy during operation of the device 10. The coolant reservoir 22 may also be in fluid communication with one or more vent components, such as a check valve or other selectively openable outlet to vent or otherwise disperse excess coolant, gas, or overpressure.

The beverage receptacles 24 may similarly define an interior volume for receiving and containing a particular beverage component(s), such as an alcoholic beverage, and may have sufficient volume to store an amount of beverage desired for a predetermined number of operational cycles or duration of use. The beverage receptacles 24 may also be in fluid communication with one or more fluid handling components 28, such as valves, pumps or regulators for the controlled and selective delivery of a particular beverage at a desired volume, pressure, and/or flow rate to one or more freezing cavities 30.

In particular, each beverage receptacle 24 may be coupled to a pump or valve by a length of piping or other suitable conduit. The pump may be metered or otherwise able to selectively dispense a predetermined amount of a desired beverage to the freezing cavities. For example, the pump or valve may be controlled to remain open for a preset period of time, thereby allowing a predetermined, fixed amount of a beverage component to pass through to the freezing cavities 30. Additionally, a sensor, such as a flow meter and/or an optical sensor, may be disposed about the fluid pathway connecting the beverage receptacle 24 to the freezing cavities 30 to measure an amount of fluid that actually traverses the pathway, and then close or deactivate the particular valve or pump. By measuring or otherwise ensuring only a predefined amount of fluid flows into the freezing cavities 30, unnecessary waste or spillage is avoided, uniformity of the frozen output of the device 10 is achieved, and the ability to track or otherwise store information regarding volume of use is also readily enabled.

Figure 4:
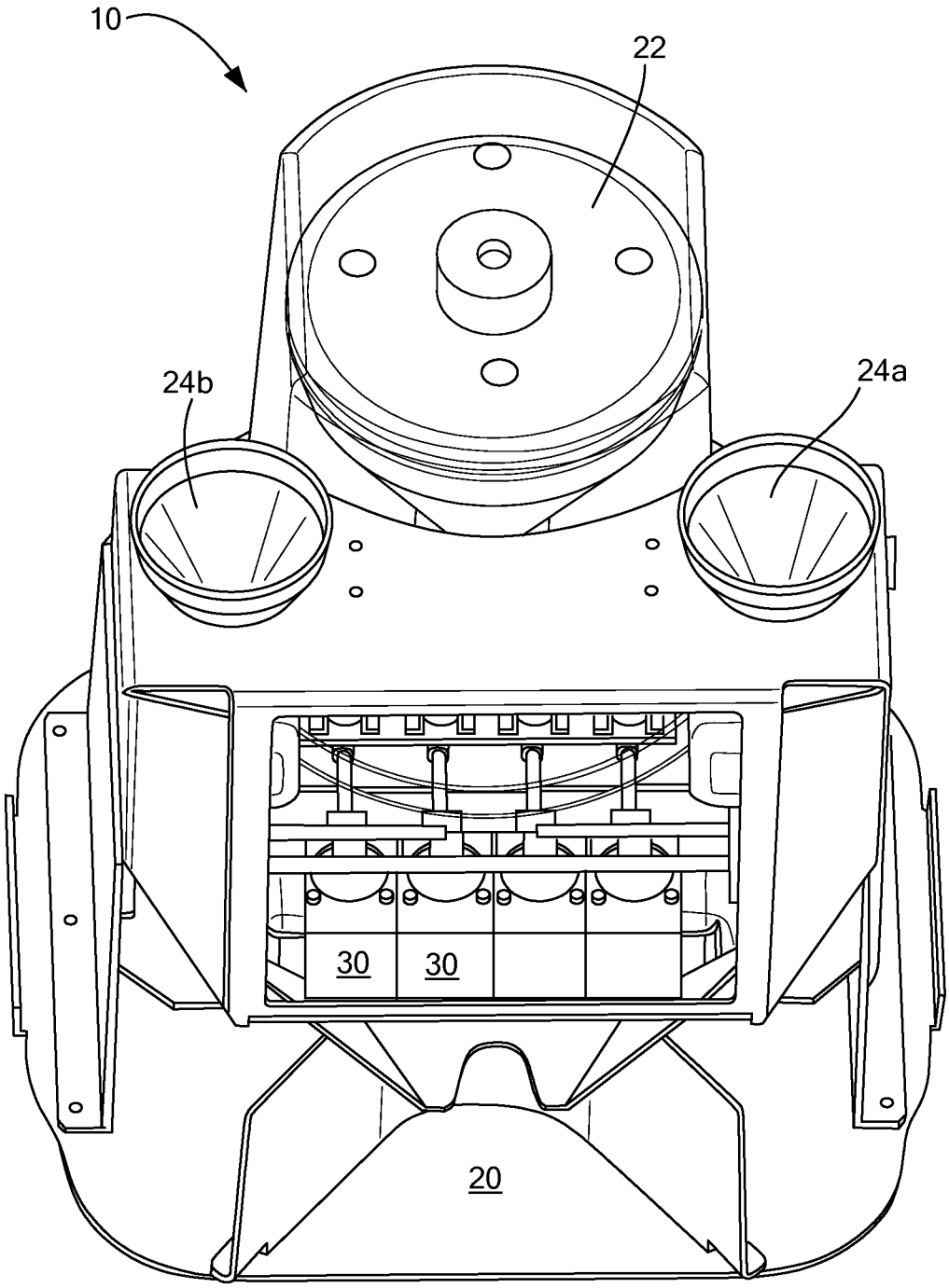
FIG. 4 is a top perspective view of the rapid fluid freezing device of FIG. 1.
Figure 5:
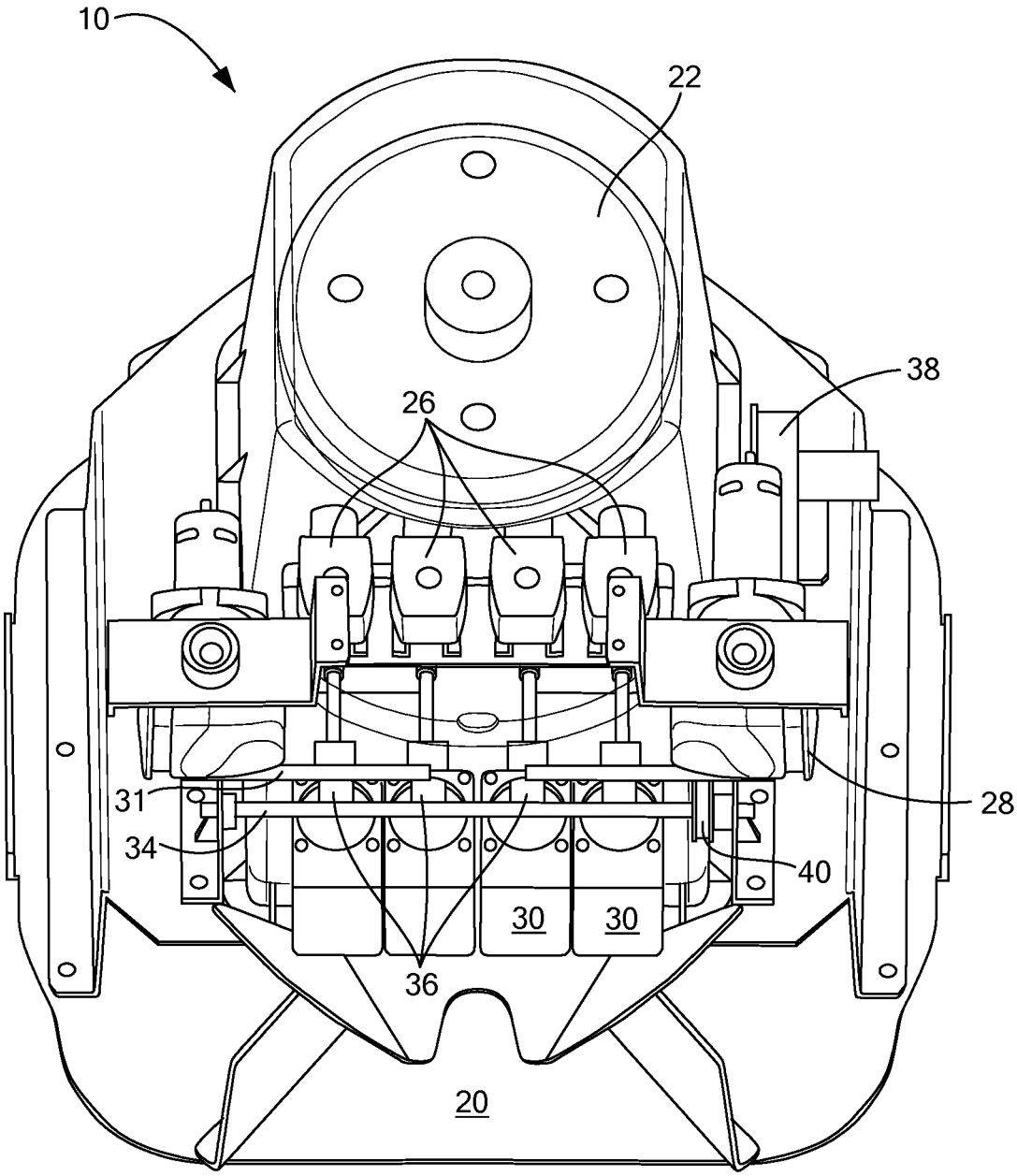
FIG. 5 is an additional top perspective view of the rapid fluid freezing device of FIG. 1.
Figure 6:
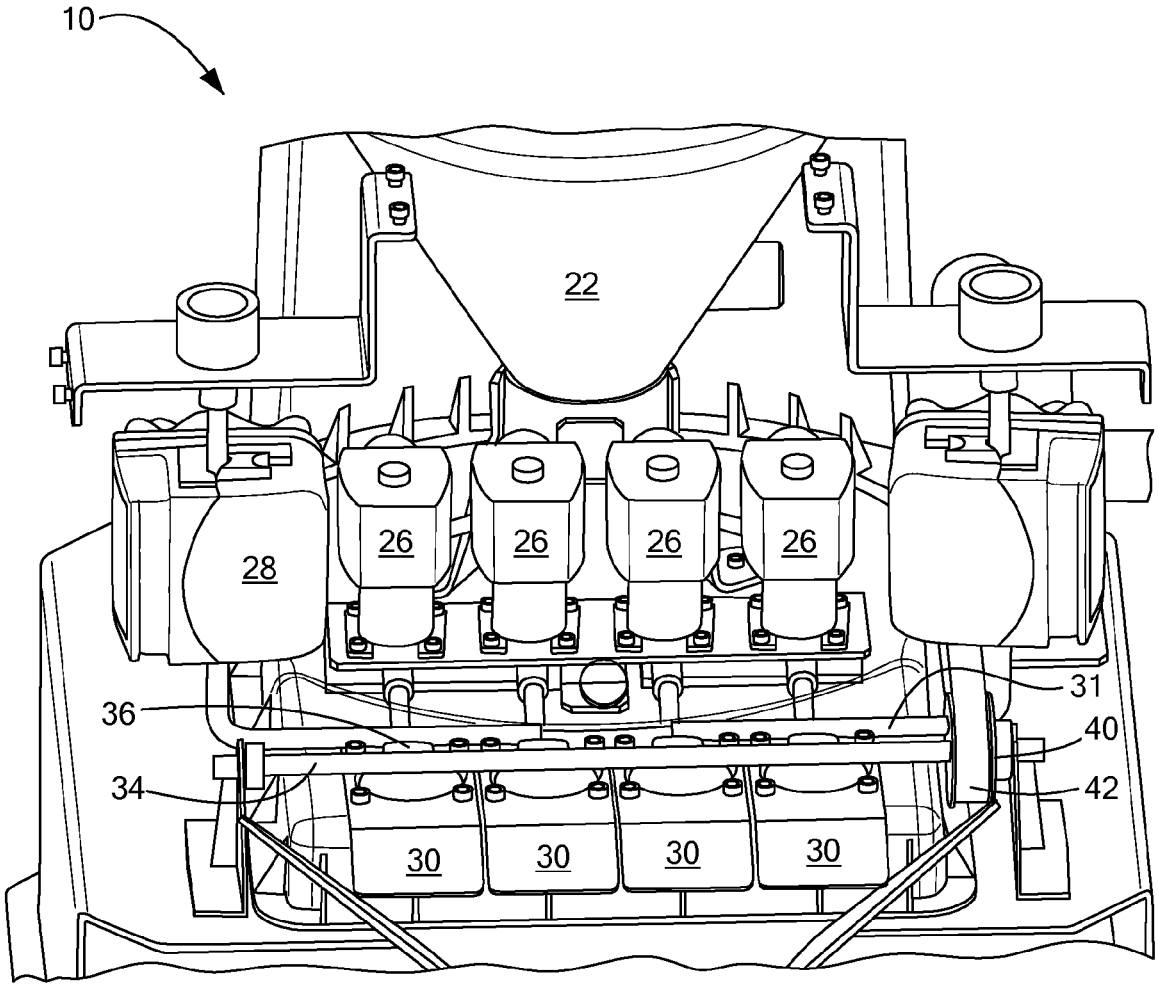
FIG. 6 is front view of the rapid fluid freezing device of FIG. 1.
Figure 7:
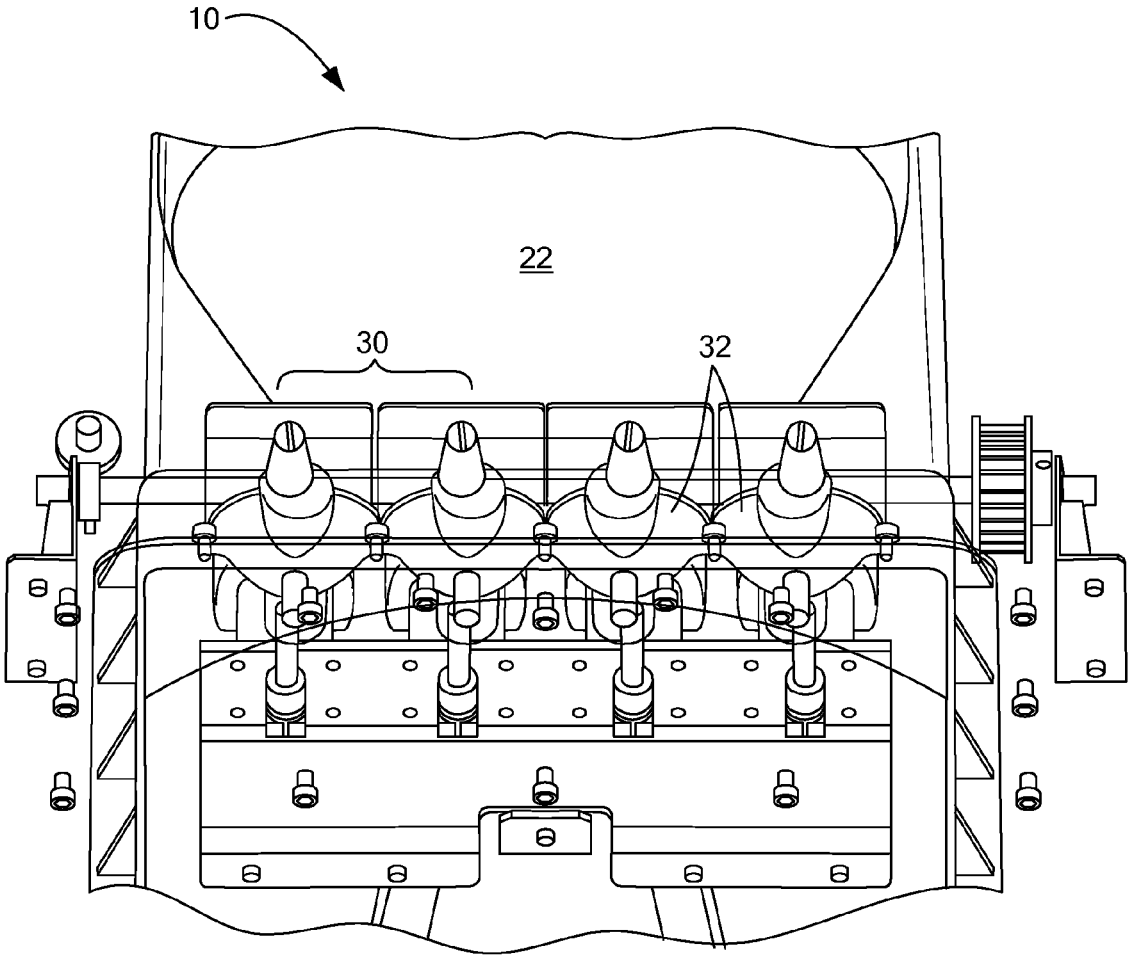
FIG. 7 is rear perspective view of the rapid fluid freezing device of FIG. 1.

Referring to FIGS. 4-6, the freezing cavities 30 may generally define a volume receiving an amount of a beverage component or fluid for subsequent freezing. In the particular illustrated embodiment, the freezing cavities include a tray-like body having a rounded, semispherical shape or depression. Of course, this shape is merely illustrative, as the cavities 30 may have numerous shapes and sizes to provide virtually any respective frozen mass having a particular desired shape or size. Furthermore, it is contemplated that a plurality of cavities 30 having differing sizes and shapes may be interchangeable with one another to readily provide a variety of frozen beverage masses. The freezing cavities 30 may further include a downward sloping surface to ease dispensing of the frozen beverage contents when freezing has completed. As shown, the cavities 30 may be arranged next to one another and in fluid communication with a conduit or fluid delivery element 31 that directs fluid from the beverage receptacles 24. Delivery of a selected beverage or alcoholic fluid may be achieved with one or more controllable valves or outlets for controllably and selectively delivering the fluid from one or more of the beverage receptacles 24 to one or more freezing cavities 30.

The freezing cavities 30 may be immersed or otherwise in thermal communication with the coolant provided by the coolant reservoir 22. For example, each freezing cavity 30 may be at least partially submersible or positionable within a coolant chamber 32 provided just underneath each freezing cavity 30. The coolant chamber 32 may have a substantially similar shape to the freezing cavity 30, but with larger or varying dimensions such that at least a portion of the freezing cavity 30 may be placed within the coolant chamber 32. The one or more coolant chambers 32 may be in fluid communication with the coolant reservoir 22 and/or the fluid handling components 26 regulating delivery of coolant to the coolant chamber 32. Coolant may thus flow into the coolant chamber 32, thereby thermally contacting at least a portion of the freezing cavities 30, and resulting the rapid cooling and freezing of the fluid contents of the freezing cavities 30. After use, portions of the coolant may be recirculated into the coolant reservoir 22 or vented out of the device 10. For example, the device 10 may include a coolant recapture system for the efficient and maximized use of coolant. Furthermore, the device 10 may include one or more filters to capture and/or contain any exhaust byproduct, should certain coolants be selected. Moreover, the device 10 may include a coolant generator to automatically and/or selectively replenish the coolant reservoir 22.

The rapid fluid freezing device 10 of the present invention may further include a dispensing assembly for removal and delivery of the frozen contents of the freezing cavities to the dispensing region of the device 10. Referring particularly to FIGS. 5 and 6, the dispensing assembly may generally include a longitudinal element or axle 34 positioned in proximity to the freezing cavities 30. For example, the axle 34 may be located above and extend longitudinally across the width on the freezing cavities 30. The axle 34 may include one or more flaps 36 extending from the axle 34, where each flap 36 is positioned just above each freezing cavity 30. The axle 34 may further be coupled to or otherwise engaged with a dispensing motor 38. For example, the axle may be coupled to a wheel 40, where the wheel 40 is coupled to the motor 38 by a belt 42. During operation, the motor 38 may turn the belt 42, thereby causing the wheel 40 to rotate. Rotation of the wheel 40, in turn, rotates the axle 34. When axle 34 is turned, the flaps 36 rotatably descend towards the freezing cavities 30, and sweep or otherwise push the contents of the freezing cavities 30 towards the dispensing region 20. The axle 34 and the flaps may complete a 360 degree rotation and return to a position above the freezing cavities 30, or the flaps 36 may be reversibly rotated to exit the freezing cavities 30 through manipulation or operation of the motor 38.

The user interface 18 of the present rapid fluid freezing device 10 may provide for the operation and control of the various components described herein. Generally, the LCD display of the user interface 18 may provide a touch-screen interface for ease of use and selection of the desired operation. The user interface 18 may include a processor and an electronic storage device or component to store the programming and related information for the features and operation disclosed herein. Primarily, user interface 18 may be manipulated to turn on the freezing mechanisms of the device 10, i.e., to dispense a beverage fluid through the beverage collection receptacles to the freezing cavities for subsequent freezing. The process may be significantly automated with preset conditions and instruction for the components of the device 10 such that a "one-touch" operation is achieved to dispense the desired frozen beverage.

The user interface 18 may further electronically communicate with one or more sensors disposed in the device 10 to monitor and control coolant levels, beverage levels, temperatures, flow rates, pressures, or the like. One or more predefined operational limits may be stored in the electronic storage of the user interface 18, and the sensor input may be compared to predefined or preset limits. Should a measured or sensed condition exceed or differ from the preset, expected value, a warning or alert may be visually or audibly generated, e.g., "Coolant Level Low," "Excess Pressure," "No Beverage Detected," etc. The user interface 18 may further function to terminate operation of the device 10 under certain circumstances, i.e., when the cover is removed, a coolant leak is detected, excess coolant vapor detected, etc.

The user interface 18 of the device 10 may record how many frozen cubes have been made in a particular time period, as well as how much beverage fluid or alcohol was used. As such, the device 10 may aid in inventory control of selected liquor beverages by storing the amount used and how many frozen alcohol cubes have been dispensed per day, week, month, or year.

In addition to providing for the operation and control of the device 10, the user interface 18 may display marketing materials, drink selection, and payment information. For example, the user interface 18 may display the type of alcohol and the brand of the liquor being frozen. Optionally, the user interface 18 of the device 10 may be connected to a credit card machine or to a private network through wireless or hard-wired components as known in the art, and thus serve as a point-of-sale system providing multiple functions typically present in a retail setting like a bar or restaurant.

In a particular method of use of the rapid fluid freezing device 10 of the present invention, a plurality of frozen beverage masses or "cubes" are prepared and dispensed. As used herein the term "cube" is intended as commonly used with "ice cubes" to encompass a mass of frozen substance, and is not intended to be limiting to a frozen mass having a square-like shape or any particular shape whatsoever. Primarily, a coolant is placed in the coolant reservoir 22 of the device 10. The coolant may be a cryogenic coolant capable of providing substantially low temperatures, such as between approximately −40° F. and approximately −160° F. The coolant may include liquid nitrogen, nitrous oxide, or other suitable refrigerants delivering the desired temperature or cooling power to the device. A desired beverage component, such as an alcoholic liquor or spirit, is poured or otherwise placed into one or more of the beverage receptacles 24. The amount desired for freezing may be poured into the receptacles 24, or the device 10 may measure or dispense a predetermined amount of the contents poured into the receptacle for subsequent freezing.

Once the desired beverage, liquor, or spirit has been poured into the receptacles 24, the user interface 18 may be operated to selectively dispense the beverage fluid into one or more freezing cavities 30. One or more beverage collection receptacles 24 may supply the desired beverage fluid to one or more freezing cavities 30, and/or the contents of multiple beverage collection receptacles 24 may be fed into a single freezing cavity 30 to create a substantially, if not completely, solid frozen beverage mass. Upon dispensing the desired beverage contents into the freezing cavities 30, coolant may then be selectively released or circulated out of the coolant reservoir 22 into the coolant chambers 32, thus exposing the freezing cavities 30 and their contents to the extremely low temperature of the coolant. The freezing cavities 30 may be exposed to the coolant for a predetermined period of time sufficient to achieve the substantially complete freezing of the contents into a solid. The duration of time may differ depending on the selection of coolant, but may generally include a duration of between approximately 30 seconds and approximately 120 seconds.

Once the freezing cavities have been exposed to the coolant for a particular amount of time needed to achieve the desired freezing of the beverage contents, the dispensing mechanism may be activated to release and dispense the now-frozen contents of the freezing cavities to the dispensing region 20 of the device 10. The remaining coolant may then either be recirculated back into the coolant reservoir 22 or vented accordingly.

Because of the significantly lower temperatures that can be achieved with the cooling power and efficiency provided by cryogenic coolants or other low-temperature refrigerants, beverages containing a high amount of ethanol may be quickly and safely frozen for the creation of unique beverages. Of course, the rapid fluid freezing device 10 described above is not limited to alcohol-based liquids, as it can be equally used to make frozen cubes from many different liquids or fluids. The present invention can be used to freeze ethanol-based drinks and create frozen alcohol cubes fast and on demand by advantageously providing a method of optimizing the delivery of a coolant to a liquid compound to achieve its freezing point and by providing an easy-to-use user interface 18 automating the process. The device 10 is thus simple to use and maintain, and can include an easily replenishable coolant source.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A device for rapidly freezing a liquid, the device comprising:

a coolant reservoir;

a plurality of stationary coolant chambers in fluid communication with the coolant reservoir;

a first beverage receptacle configured to receive the liquid; and a plurality of freezing cavities in fluid communication with the first beverage receptacle, at least a portion of each freezing cavity being positioned within and in thermal communication with one of the coolant chambers, each coolant chamber being fluidly isolatable from another coolant chamber;

a sensor disposed between the first beverage receptacle and the freezing cavities configured to measure the amount of coolant flowing between the first beverage receptacle and the freezing cavities; and the plurality of freezing cavities being configured to freeze solid the liquid after being received within the first beverage receptacle.

2. The device according to claim 1, further comprising at least one of a valve, pump, and regulator in fluid communication with the coolant reservoir for selectively dispensing a coolant from the reservoir to each coolant chamber.

3. The device according to claim 2, further comprising at least one of a valve, pump, and regulator in fluid communication with the beverage receptacle for selectively dispensing a fluid from the beverage receptacle to at least one of the freezing cavities.

4. The device according to claim 3, further comprising a user interface for allowing selective operation of at least one of the first and second fluid handling components.

5. The device according to claim 4, wherein the user interface includes a liquid crystal display.

6. The device according to claim 4, wherein the sensor is one of a temperature sensor, pressure sensor, and flow sensor in electrical communication with the user interface.

7. The device according to claim 1, further comprising a dispensing mechanism coupled to each freezing cavity to dispense the frozen solid liquid of each freezing cavity.

8. The device according to claim 1, further comprising a plurality of beverage receptacles.

9. The device of claim 1, wherein the liquid is alcohol, and wherein the plurality of freezing cavities are configured to at least freeze solid the liquid to at least −40° C.

* * * * *